US007460000B2

(12) United States Patent
Kudo et al.

(10) Patent No.: US 7,460,000 B2
(45) Date of Patent: Dec. 2, 2008

(54) CHIP INDUCTOR AND METHOD FOR MANUFACTURING THE SAME

(75) Inventors: Hayami Kudo, Yasu (JP); Masahiko Kawaguchi, Machida (JP); Yasuhiro Nakata, Sagamihara (JP)

(73) Assignee: Murata Manufacturing Co. Ltd., Kyoto (JP)

( * ) Notice: Subject to any disclaimer, the term of this patent is extended or adjusted under 35 U.S.C. 154(b) by 247 days.

(21) Appl. No.: 10/556,700

(22) PCT Filed: Nov. 17, 2004

(86) PCT No.: PCT/JP2004/017068

§ 371 (c)(1),
(2), (4) Date: Nov. 15, 2005

(87) PCT Pub. No.: WO2005/071699

PCT Pub. Date: Aug. 4, 2005

(65) Prior Publication Data

US 2007/0069844 A1 Mar. 29, 2007

(30) Foreign Application Priority Data

Jan. 23, 2004 (JP) ..... 2004-015805

(51) Int. Cl.
*H01F 5/00* (2006.01)

(52) U.S. Cl. ..... 336/200; 336/232

(58) Field of Classification Search ..... 336/200
See application file for complete search history.

(56) References Cited

U.S. PATENT DOCUMENTS

| | | | | |
|---|---|---|---|---|
| 6,683,523 | B2 * | 1/2004 | Takashima et al. | 336/200 |
| 6,885,276 | B2 * | 4/2005 | Iha et al. | 336/200 |
| 2002/0157849 | A1 | 10/2002 | Sakata | |

FOREIGN PATENT DOCUMENTS

| | | |
|---|---|---|
| JP | 05-029147 | 2/1993 |
| JP | 09-017634 | 1/1997 |
| JP | 2000-049014 | 2/2000 |
| JP | 2001-006936 | 1/2001 |
| JP | 2002-246231 | 8/2002 |
| JP | 2003-007535 | 1/2003 |

* cited by examiner

*Primary Examiner*—Elvin G Enad
*Assistant Examiner*—Joselito Baisa
(74) *Attorney, Agent, or Firm*—Keating & Bennett, LLP

(57) ABSTRACT

A chip inductor is constructed by alternately laminating plural conductor patterns and plural insulating layers on and above a ceramic substrate, and connecting the plural conductor patterns to each other in series in a lamination direction thereof so as to constitute a coil. Specifically, the number of turns of the lowermost conductor pattern disposed directly on the ceramic substrate is larger than the number of turns of the other plural conductor patterns and the number of turns of the other plural conductor patterns are substantially equal to each other. Preferably, the number of turns of the lowermost conductor pattern is about 1.5 times the number of turns of the other plural conductor patterns.

12 Claims, 6 Drawing Sheets

FIG. 6
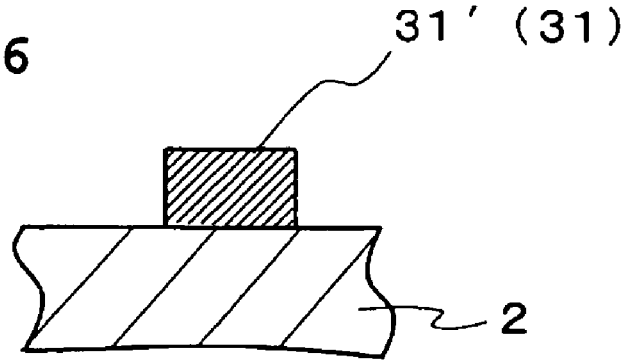
FIG. 7A
FIG. 7B
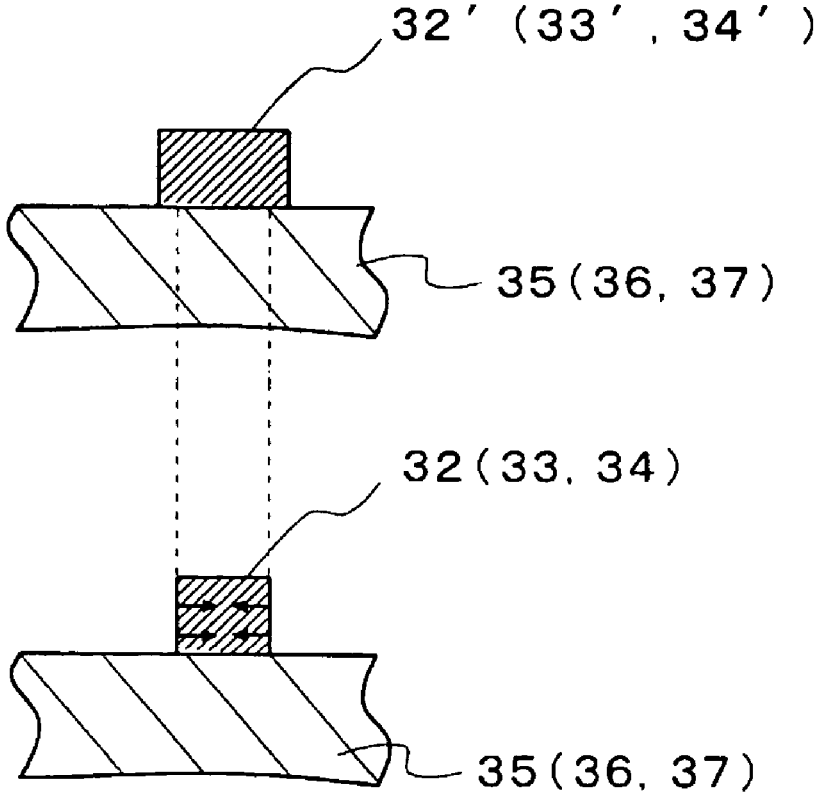

CHIP INDUCTOR AND METHOD FOR MANUFACTURING THE SAME

BACKGROUND OF THE INVENTION

1. Field of the Invention

The present invention relates to a chip inductor including alternately laminated conductor patterns and insulating layers constituting a coil, as well as a method for manufacturing the same.

2. Description of the Related Art

A chip inductor in the shape of a small, low-profile chip in outline is one type of extremely high performance, versatile electronic component compatible with miniaturization and slimming of electronic equipment. The chip inductor is incorporated into various electronic circuits, and is used as a noise filter, for example.

A first example of known technologies related to this type of inductor is a technology disclosed in Japanese Unexamined Patent Application Publication No. 9-17634, for example. This inductor is a laminated inductor constructed by alternately laminating coil conductors and low dielectric constant insulating films on an insulating substrate, and connecting the coil conductors located on and under the individual low dielectric constant insulating film to each other through a window portion provided in the low dielectric constant insulating film (so-called interlayer connection), so as to form one series of a coil connected in series in the entire chip inductor. In this laminated inductor, laminates of the coil conductors and the low dielectric constant insulating films are further layered to increase the inductance of the above-described one series of coil as a whole. That is, the total number of turns of the entire coil is increased and, thereby, a desired high inductance value is attained while the line width and the thickness of each coil conductor are ensured to achieve a reduction in direct-current resistance. As a result, realization of excellent Q characteristic is possible.

A second known technology is a technology disclosed in Japanese Unexamined Patent Application Publication No. 2002-246231, for example. In this technology, coil conductors having a large number of turns are disposed on an upper layer side and a lower layer side of the laminate in the above-described laminated inductor, and coil conductors having a small number of turns are disposed as intermediate layers sandwiched between the upper layer and the lower layer, so that the distribution of the direct-current resistance value is non-uniform throughout the coil. That is, the middle portion (intermediate layer portion) of the laminate has low direct-current resistance, and the portions nearer to the outside, such as the upper layer and the lower layer, have high direct-current resistance. In this manner, it is attempted to reduce the pressure bonding strain during production of the laminate, as well as to improve the heat dissipation characteristics of the laminated inductor.

However, in the above-described first known technology, the following problems may occur.

That is, when the laminates of the coil conductors and the low dielectric constant insulating layers are further layered to increase the inductance of the entire coil, although the line width may not be reduced, the thickness (height) of the external dimension of the entire laminate is increased by the thickness of the further layered portion. Therefore, advantages of the chip inductor, i.e. small size and low profile, may be impaired.

In the second technology, since the coil conductors having the large number of turns are disposed on the upper layer side and the lower layer side of the laminate, excellent heat dissipation characteristics can be attained while the inductance is increased. However, with respect to the layers having the small number of turns, the line width of the coil conductor must be increased in order to reduce the direct-current resistance value. Consequently, the inner diameter of the coil is decreased correspondingly, the inductance is decreased, and the Q characteristic may be reduced. Furthermore, with respect to the layers having the large number of turns, setting of the line width is restricted. Therefore, when this layer is fired during the manufacturing of a chip inductor, the line width of this layer is decreased by shrinkage and, as a result, there is also a problem in that the direct-current resistance value is increased.

SUMMARY OF THE INVENTION

To overcome the problems described above, preferred embodiments of the present invention provide a chip inductor in which excellent Q characteristic is realized while advantages in its small size and low profile are ensured, as well as a method for manufacturing the same.

In order to overcome the above-described problems, according to a preferred embodiment of the present invention, a chip inductor includes a chip main body and a pair of external connection electrodes, the chip main body including a substrate and a laminate including plural conductor patterns and plural insulating layers alternately laminated on the substrate while the plural conductor patterns are connected to each other in series in the lamination direction thereof so as to constitute a coil, one of the external connection electrodes attached to one side-end surface of the chip main body and connected to one end of the coil, and the other external connection electrode attached to the other side-end surface and connected to the other end of the coil, wherein the outer diameter dimensions of the plural conductor patterns constituting the coil are substantially equal and any one of plural conductor patterns in the lower half of the plural conductor patterns is a conductor pattern having the largest number of turns, and the thickness of the laminate and the thickness of the substrate are substantially equal, so that the lowermost-layer conductor pattern is located substantially in the midsection of the chip main body.

By adopting such a configuration in the coil in which plural conductor patterns are connected in series, any one of the plural conductor patterns located in the lower half of the plural conductor patterns becomes the conductor pattern having the largest number of turns and, therefore, the inductance is increased correspondingly. Since the plural conductor patterns other than the above-described conductor pattern have a small number of turns, the direct-current resistance of the entire coil can be maintained at a low value.

Another preferred embodiment is the chip inductor described above, wherein the lowermost-layer conductor pattern is the conductor pattern having the largest number of turns and, in addition, the number of turns of the other plural conductor patterns are substantially equal to each other.

By adopting such a configuration in the coil, only the lowermost-layer conductor pattern has the largest number of turns and, therefore, the inductance is increased correspondingly. Since the majority of the plural conductor patterns do not require a large numbers of turns, the direct-current resistance of the entire coil can be maintained at a lower value. Since only the lowermost-layer conductor pattern has the largest number of turns and the inductance thereof is increased, there is no need to increase the number of laminations of conductor patterns.

Another preferred embodiment of the present invention provides a chip inductor as described above, wherein the number of turns of the lowermost-layer conductor pattern is about 1.5 times the number of turns of the other plural conductor patterns.

By adopting such a configuration, the inductance value of the entire coil can be further improved and, in addition, an increase in the direct-current resistance value can be further reduced.

Another preferred embodiment of the present invention provides a chip inductor as described above, wherein the number of turns of the lowermost-layer conductor pattern is about 1.5 turns, and the number of turns of the other conductor patterns is about 1 turn.

Another preferred embodiment of the present invention provides a chip inductor as described above, wherein each of the external connection electrodes has a sectional shape similar to that of a substantially square bracket extending from a top surface of the chip main body to a bottom surface along the side-end surface.

Another preferred embodiment of the present invention provides a chip inductor as described above, wherein each of the external connection electrodes is disposed so as to prevent the magnetic fluxes generated by the coil from passing through portions of the external connection electrodes located on the top surface and the bottom surface of the chip main body.

By adopting such a configuration, the external connection electrodes do not interrupt the magnetic field generated by the coil in the chip inductor.

Another preferred embodiment of the present invention provides a chip inductor as described above, wherein the plural conductor patterns are connected in series in the lamination direction through openings disposed in the insulating layers so as to constitute the coil.

Another preferred embodiment of the prevent invention provides a chip as inductor described above, wherein the substrate is a ceramic substrate or a wafer, the conductor patterns are disposed by patterning and firing a photosensitive conductor paste, and the insulating layers are disposed by firing an insulating material paste.

Another preferred embodiment of the prevent invention provides a chip inductor as described above, wherein the line widths of the plural conductor patterns are substantially equal to each other.

Another preferred embodiment of the prevent invention provides a method for manufacturing a chip inductor, wherein a step of forming a conductor pattern by patterning and firing a photosensitive conductor paste and a subsequent step of firing an insulating layer are alternately repeated plural times on a ceramic substrate or a wafer so as to produce a chip inductor including a coil constructed by connecting the plural conductor patterns to each other in series in the lamination direction, the method including the step of setting the number of turns of the lowermost-layer conductor pattern, among the plural conductor patterns, disposed directly above the ceramic substrate or the wafer to be larger than the number of turns of the other plural conductor patterns, and setting the number of turns of the other plural conductor patterns to be substantially equal to each other.

By adopting such a configuration, since the lowermost-layer conductor pattern is disposed directly above the ceramic substrate or the wafer, the shrinkage during the firing is less than those of the other plural conductor patterns disposed on the insulating layers. As a result, the number of turns can be made larger than the number of turns of the other plural conductor patterns, while a desired line width is ensured.

Another preferred embodiment of the prevent invention provides a method for manufacturing a chip inductor as described above, wherein the lowermost-layer conductor pattern has a number of turns of about 1.5 times the number of turns of the other plural conductor patterns.

By adopting such a configuration, since the shrinkage of the lowermost-layer conductor pattern during the firing is low, the number of turns can be increased and, in combination with this, the reduction in the line width during the firing is reduced. Consequently, an increase in the inductance value and a reduction of an increase in the direct-current resistance value of the resulting entire coil can be further enhanced.

Another preferred embodiment of the prevent invention provides a method for manufacturing a chip inductor as described above, wherein openings are disposed in the insulating layers, and the plural conductor patterns are connected to each other in series in the lamination direction thereof through the openings so as to constitute the coil.

In the chip inductors according to the various preferred embodiments described above, the inductance of the coil in which plural conductor patterns are connected in series can be increased and, in addition, the direct-current resistance of the coil can be maintained at a low value. Consequently, the Q characteristic of the entire coil can be improved.

In particular, according to the chip inductor of the various preferred embodiments described above, only the lowermost-layer conductor pattern has the largest number of turns and, therefore, the inductance is increased correspondingly. Since the majority of the plural conductor patterns are in no need of having a large numbers of turns, the direct-current resistance of the entire coil can be maintained at a lower value. As a result, the Q characteristic of the entire coil can be improved. Since only the lowermost-layer conductor pattern has the largest number of turns and, thereby, the inductance is increased, as described above, slimming of the entire inductor can be achieved without increasing the number of laminations of the conductor patterns.

According to the chip inductors described above, since the number of turns of the lowermost-layer conductor pattern is preferably about 1.5 times the number of turns of the other plural conductor patterns, an increase in the inductance value and a reduction of an increase in the direct-current resistance value of the entire coil can be achieved. Consequently, the Q characteristic of the entire coil can be further improved.

According to the chip inductor described above, since the external connection electrodes do not interrupt the magnetic field generated by the coil, the inductance of the entire coil can be further improved, and further improvement of the Q characteristic can be achieved.

According to the methods for manufacturing a chip inductor described above, since the number of turns of the lowermost-layer conductor pattern can be made larger than the number of turns of the other plural conductor patterns while a desired line width is ensured, the inductance can be increased by increasing the number of turns of the lowermost-layer conductor pattern without increasing the number of lamination layers, and the line width can be ensured by decreasing the number of turns of the plural conductor patterns other than the lowermost-layer conductor pattern. Furthermore, since the shrinkage of the lowermost-layer conductor pattern during the firing is less than those of the other plural conductor patterns disposed on the insulating layers and a desired line width is substantially maintained, the direct-current resistance value of the entire coil can be lowered. As a result, the Q characteristic of the entire coil can be improved while the entire inductor remains low-profile.

Other features, elements, steps, characteristics, and advantages of the present invention will become more apparent from the following description of preferred embodiments of the present invention with reference to the attached drawings.

BRIEF DESCRIPTION OF THE DRAWINGS

FIG. 6 is a sectional view showing a lowermost-layer conductor pattern during firing.

FIGS. 7(*a*) and 7(*b*) are sectional views schematically showing a shrinkage phenomenon of the other conductor patterns in a line width direction during firing.

DETAILED DESCRIPTION OF PREFERRED EMBODIMENTS

Preferred embodiments of the present invention will now be described below with reference to the drawings.

First Preferred Embodiment

Figure 1:
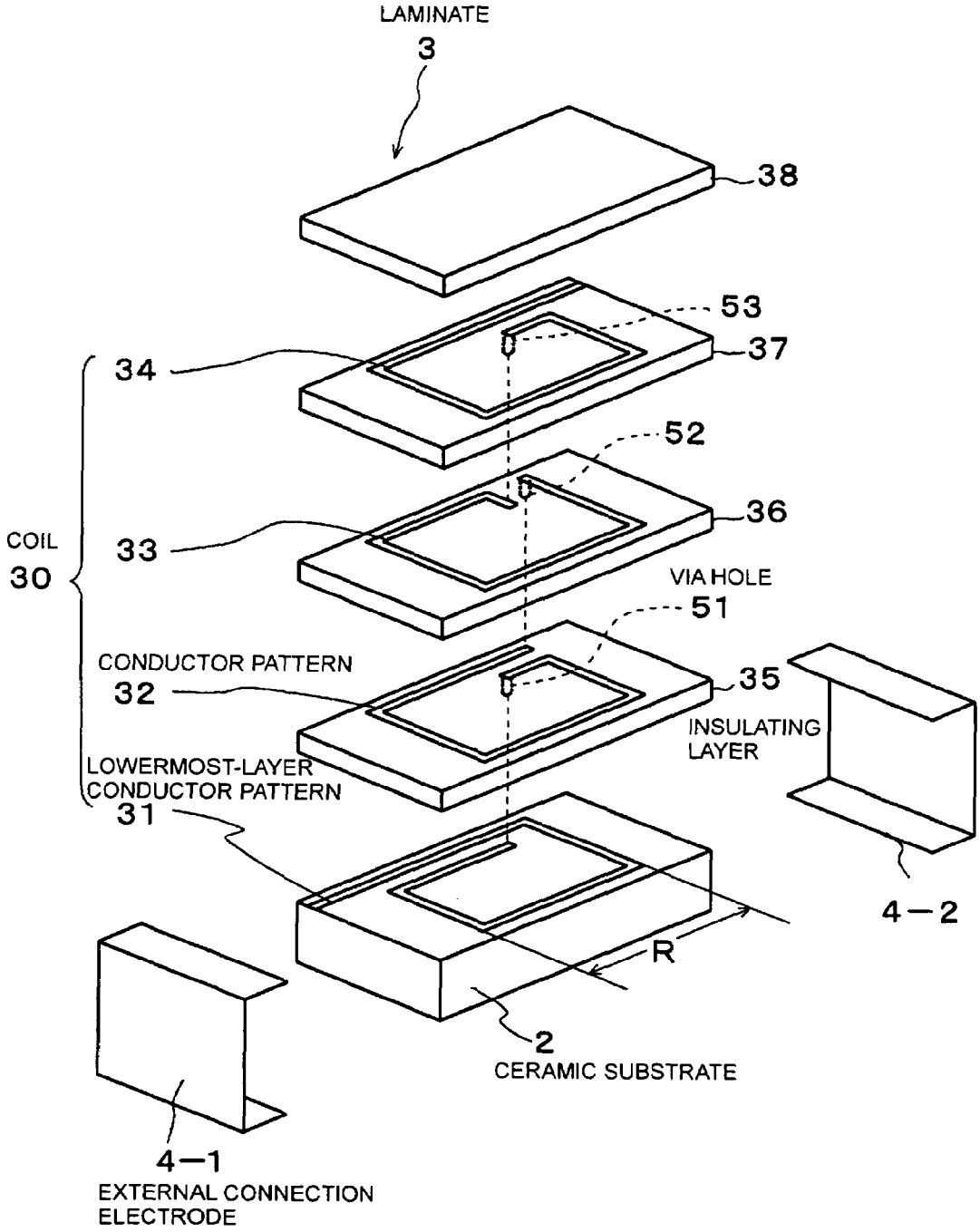
FIG. 1 is a perspective exploded view of a chip inductor according to a preferred embodiment of the present invention.
Figure 2:
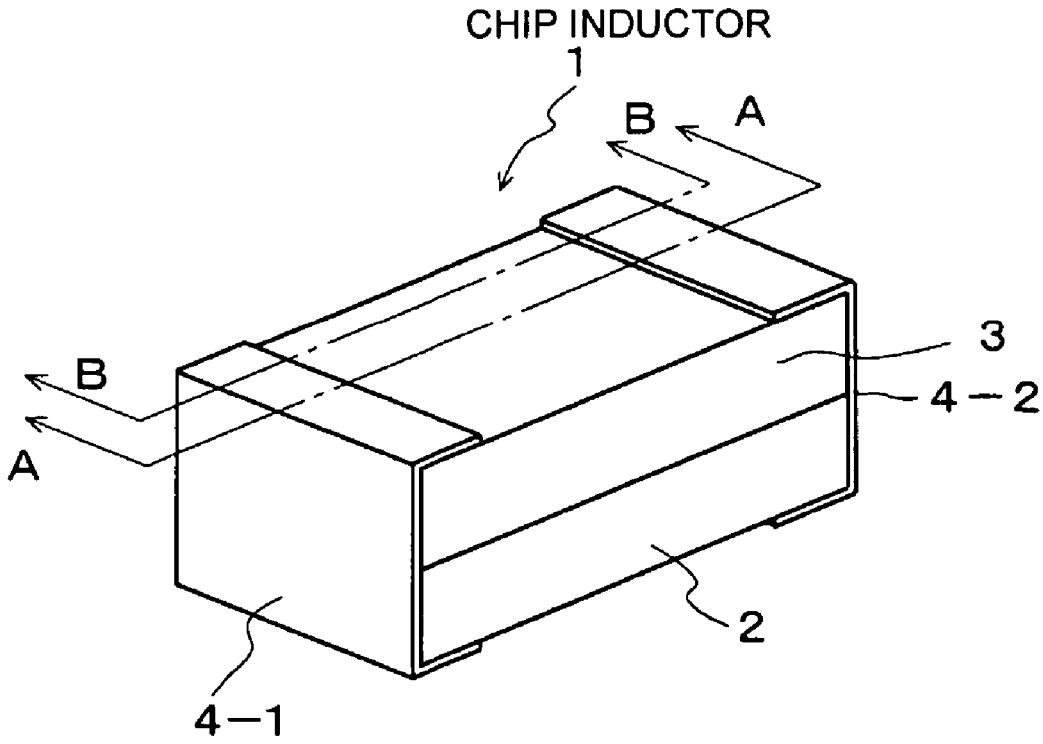
FIG. 2 is a perspective view showing an appearance of a chip inductor.
Figure 3:
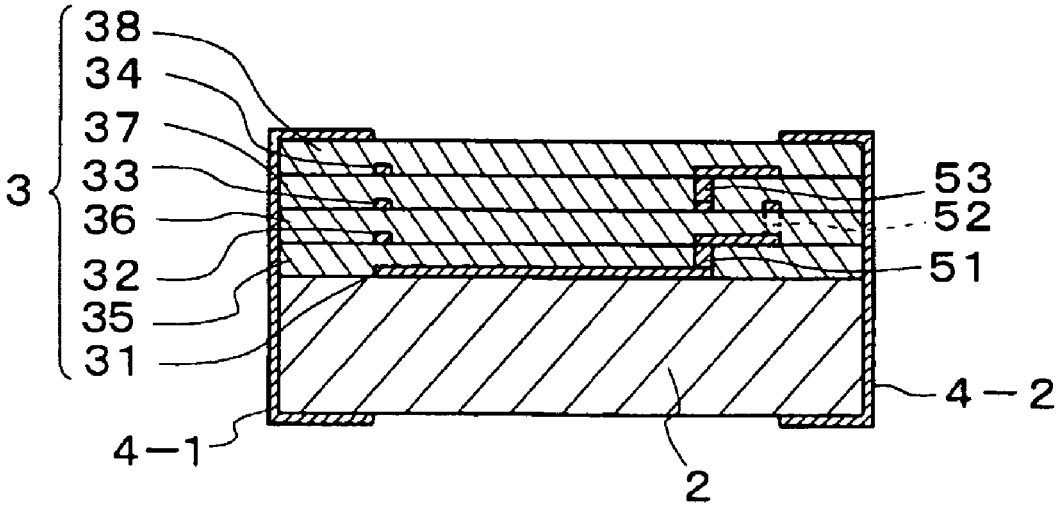
FIG. 3 is a sectional view of a section showing via hole portions, the section taken along a line A-A shown in FIG. 2.
Figure 4:
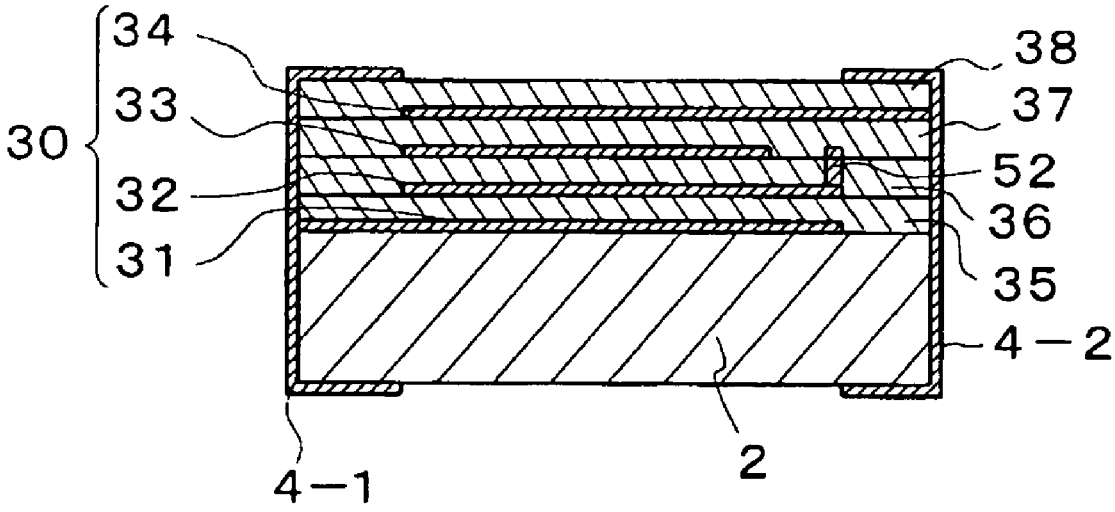
FIG. 4 is a sectional view of a section showing junctions between a coil and external connection electrodes, the section taken along a line B-B shown in FIG. 2.
Figure 5A:
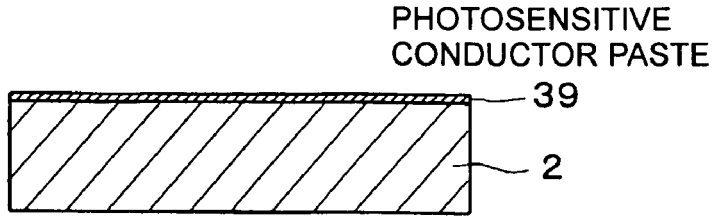
FIGS. 5(*a*)-5(*f*) are step diagrams showing a main flow of a production process of a chip inductor.
Figure 5B:
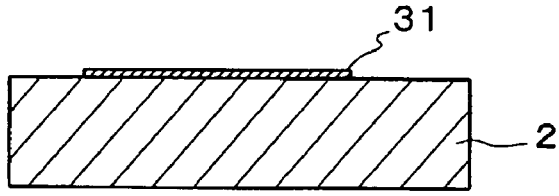
Figure 5C:
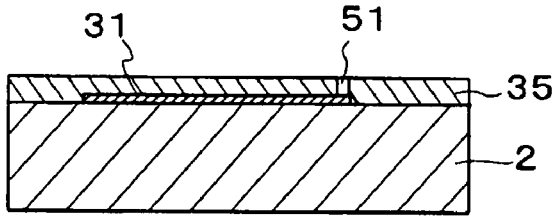
Figure 5D:
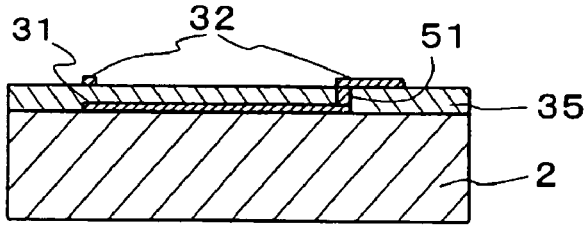
Figure 5E:
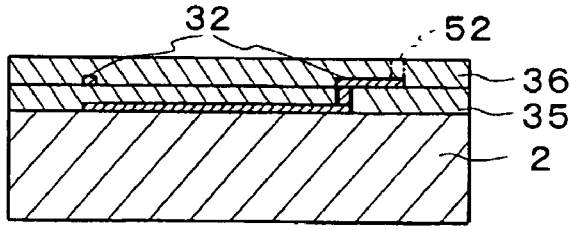
Figure 5F:
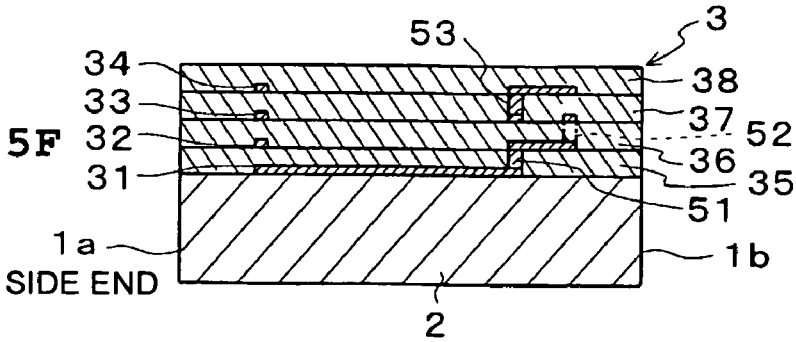

FIG. 1 is a perspective exploded view of a chip inductor according to a preferred embodiment of the present invention, and FIG. 2 is a perspective view of the chip inductor. FIG. 3 is a sectional view of a section showing via hole portions, the section taken along a line A-A shown in FIG. 2. FIG. 4 is a sectional view of a section showing junctions between a coil and external connection electrodes disposed in the chip inductor, the section taken along a line B-B shown in FIG. 2.

A chip inductor 1 of the present preferred embodiment includes a ceramic substrate 2, a laminate 3 disposed thereon, and external connection electrodes 4-1 and 4-2 attached to the left end and the right end, respectively, of a chip main body including the ceramic substrate 2 and the laminate 3.

The ceramic substrate 2 is preferably produced by cutting and firing an alumina substrate of about 0.15 mm in thickness, for example, into a very small size of about 0.6 mm in length by about 0.3 mm in width, for example.

As shown in FIG. 1, the laminate 3 is preferably produced by alternately laminating plural conductor patterns 31 to 34 having the same outer diameter dimension R and plural insulating layers 35 to 38.

The conductor pattern 31 among the plural conductor patterns 31 to 34 is a conductor pattern having the largest number of turns, and is disposed directly on the surface of the ceramic substrate 2 so as to be located as the lowermost layer. The number of turns of this conductor pattern 31 is preferably about 1.5 turns, and is preferably about 1.5 times the number of turns of the other plural conductor patterns 32, 33, and 34. Therefore, each of the number of turns of the other plural conductor patterns 32, 33, and 34 is preferably about 1 turn.

The line width of the thus configured conductor patterns 31 to 34 are substantially equal, and the conductor patterns 31 to 34 are sequentially connected in series in the lamination direction thereof through their respective openings, i.e. via holes 51, 52, and 53, so as to constitute a coil 30.

Specifically, as shown in FIG. 3 as well, the conductor pattern 31 having about 1.5 turns is disposed on the ceramic substrate 2, and the insulating layer 35 is disposed by lamination while covering this conductor pattern 31 and the surface of the ceramic substrate 2. The conductor pattern 32 having about 1 turn is disposed on the surface of the insulating layer 35, and the insulating layer 36 is disposed by lamination while covering this conductor pattern 32 and the surface of the insulating layer 35. Furthermore, the conductor pattern 33 having about 1 turn is disposed on the surface of the insulating layer 36, and the insulating layer 37 is disposed by lamination while covering this conductor pattern 33 and the surface of the insulating layer 36. The conductor pattern 34 having about 1 turn is disposed on the surface of this insulating layer 37, and the insulating layer 38 doubling as an exterior layer is disposed by lamination while covering this conductor pattern 34 and the surface of the insulating layer 37.

The conductor patterns 31 to 34 of the laminate 3, as described above, are produced by patterning and firing a photosensitive paste primarily containing silver, glass, and the like, as described below, and the insulating layers 35 to 38 are produced by printing and firing an insulating paste primarily containing glass and the like.

The thickness of this laminate 3 is preferably equal to the thickness of the ceramic substrate 2 and is preferably about 0.15 mm, for example. That is, the thickness of the ceramic substrate 2 is about one-half the thickness of the entire chip inductor. Therefore, the lowermost-layer conductor pattern 31 disposed directly on the surface of the ceramic substrate 2 is located substantially in the midsection in the thickness direction of the chip main body composed of the ceramic substrate 2 and the laminate 3.

As shown in FIG. 2, the external connection electrodes 4-1 and 4-2 preferably have a shape that is substantially similar to that of a square bracket, and are attached to their respective side-end surfaces of the chip main body composed of the ceramic substrate 2 and the laminate 3 while covering a portion of the top surface and a portion of the bottom surface, as well as their respective side-end surfaces. That is, as shown in FIG. 3, each of the external connection electrodes 4-1 and 4-2 has a cross-section in the shape of a square bracket extending from a top surface of the insulating layer 38, which is the top surface of the chip main body, to a bottom surface of the ceramic substrate 2, which is the bottom surface of the chip main body, along the side-end surface (a left or right side surface in FIG. 3) of the chip main body. These external connection electrodes 4-1 and 4-2 are connected to respective terminals of the coil 30. Specifically, as shown in FIG. 4, the external connection electrode 4-1 is connected to the conductor pattern 31, and the external connection electrode 4-2 is connected to the conductor pattern 34. Each of the surfaces of these external connection electrodes 4-1 and 4-2 is plated with Ni, Sn, Cu, or the like, and therefore, excellent electrical conductivity, excellent connectivity to the outside, and the like are achieved.

A method for manufacturing this chip inductor will be described below.

FIGS. 5(*a*)-(*f*) are step diagrams showing a main flow of a production process of this chip inductor.

As shown in FIG. 5(*a*), a photosensitive conductor paste 39 is applied to the surface of the ceramic substrate 2. The resulting paste is patterned by photolithography to prepare an unfired pattern in the shape of a partial sheet coil of about 1.5 turns, and firing is performed so that the lowermost-layer conductor pattern 31 of about 1.5 turns is provided, as shown in FIG. 5(*b*).

The unfired conductor pattern tends to shrink during firing. However, since the conductor pattern 31 is disposed on the ceramic substrate 2, shrinkage of the line width of the conduction portion 31 during the firing is very little as compared with shrinkage of the line widths of the other conductor patterns 32, 33, and 34.

Following the above-described step, as shown in FIG. 5(*c*), the insulating layer 35 is formed to cover the conductor pattern 31 and the surface of the ceramic substrate 2, a via hole 51 is formed and, thereafter, firing is performed.

As shown in FIG. 5(*d*), a photosensitive conductor paste 39 (not shown) similar to that described above is applied to the surface of the insulating layer 35. The resulting paste is patterned by photolithography to form an unfired pattern in the shape of a partial sheet coil of about 1 turn. At this time, the photosensitive conductor paste 39 enters the via hole 51. The pattern is fired in such a state and, thereby, the conductor pattern 32 having about 1 turn is formed. This conductor pattern 32 is electrically connected to the conductor pattern 31 through the via hole 51.

In the firing at this time, since the insulating layer 35 contains glass as a primary material and the unfired conductor pattern disposed thereon is made of a silver paste material, the glass serves as a promoter of sintering of the silver, and the shrinkage of the line width of the conductor pattern 32 is increased. Consequently, the conductor pattern 32 produced by the firing shrinks significantly as compared with that in the case where the conductor pattern 31 is fired. However, since this conductor pattern 32 has a number of turns that is smaller than that of the lowermost-layer conductor pattern 31, it is possible to take the decrease of the line width due to the above-described shrinkage into consideration in advance and to correspondingly set the dimensions of the line width and the like of the unfired conductor pattern 32 on the larger side. In this manner, in spite of a high probability of a decrease in the line width of the conductor pattern 32 on the insulating layer 35 during the firing, the fired conductor pattern 32 can be formed to have a desired line width. More preferably, the line width of the conductor pattern 32 becomes substantially equal to the line width of the conductor pattern 31.

Subsequently, as shown in FIG. 5(*e*), the insulating layer 36 is formed to cover the conductor pattern 32 and the surface of the insulating layer 35, a via hole 52 is formed, and, thereafter, firing is performed.

As shown in FIG. 5(*f*), the conductor pattern 33 having the same number of turns as that of the conductor pattern 32, the insulating layer 37 including a via hole 53, the conductor pattern 34 having the same number of turns as that of the conductor pattern 32, and the insulating layer 38 doubling as a protective layer are sequentially formed in that order by lamination on this insulating layer 36. The thus prepared wafer is divided by scribing and roller breaking, so that each chip main body of about 0.6 mm by about 0.3 mm, for example, is produced.

In the inside of the laminate 3 of the thus produced chip main body, the lowermost-layer conductor pattern 31 of about 1.5 turns and the other conductor patterns 32, 33, and 34 of about 1 turn are connected in series in the lamination direction thereof through via holes 51, 52, and 53, so as to constitute the coil 30.

The external connection terminals 4-1 and 4-2 connected to the two respective ends of this coil 30 are attached to the two side-ends 1*a* and 1*b*, respectively, of the chip main body by baking, plating, or the like, so that the chip inductor 1 shown in FIG. 1 to FIG. 3 is completed.

The operations and the effects of the chip inductor of the present preferred embodiment and the manufacturing method therefore will now be described.

The shrinkage of the conductor patterns 31 to 34 during the firing and the effects thereof will now be described.

FIG. 6 is a sectional view showing the lowermost-layer conductor pattern during the firing. FIGS. 7(*a*) and 7(*b*) is a sectional view schematically showing a shrinkage phenomenon of the other conductor patterns in a line width direction during the firing.

As shown in FIG. 6, the lowermost-layer conductor pattern 31 is disposed on the ceramic substrate 2. Although glass serves as a promoter of sintering of the conductor pattern 31, glass is not present in the ceramic substrate 2. Therefore, the line width of the conductor pattern 31 is hardly decreased when an unfired conductor pattern 31' is fired.

In this manner, the shrinkage of the conductor pattern 31 disposed on the ceramic substrate 2 is very little even after being subjected to a firing step as compared with the shrinkage of the conductor patterns 32, 33, and 34 and, therefore, the cross-sectional area thereof can be maintained at a desired size after the firing. Consequently, an increase in inductance due to an increase in the number of turns can be achieved while an increase in direct-current resistance value due to the line width shrinkage is minimized. As a result, the Q characteristic of the coil 30 can be improved. Furthermore, since the number of turns is increased in the conductor pattern 31, there is no need to increase the number of laminations of the other conductor patterns 32, 33, and 34. As a result, the thickness of the entire chip inductor 1 can be reduced.

On the other hand, as for the conductor patterns 32, 33, and 34, since the conductor pattern 32' (33', 34') is disposed on the insulating layer 35 (36, 37) before firing, as shown in FIG. 7(*a*), the glass primarily contained in the insulating layer 35 (36, 37) serves as a promoter of sintering of silver in the conductor pattern 32' (33', 34'). Consequently, as shown in FIG. 7(*b*), the line width of the conductor pattern 32 (33, 34) shrinks significantly during firing as compared with that in the case where the conductor pattern 31 is fired. However, the number of turns of the conductor pattern 32 (33, 34) is about 1 turn, and is a number of turns that is less than that of the lowermost-layer conductor pattern 31. Therefore, it is possible to set in advance the dimension of the line width of the unfired conductor pattern 32' (33', 34') on the larger side as compared with the finished measurements of the line width. Consequently, the conductor pattern 32 (33, 34) having the line width substantially equal to that of the conductor pattern 31 can be formed by taking the decrease of the line width during the firing into consideration in advance and correspondingly setting the line width of the unfired conductor pattern 32' (33', 34') on the larger side.

In this manner, the conductor patterns 32, 33, and 34 can be formed to have a desired line width with a small number of turns. Consequently, the direct-current resistance of the entire coil 30 can be maintained at a low value and, as a result, the Q characteristic of the entire coil 30 can be improved.

The number of turns of the conductor patterns 31 to 34 will be described below.

In the present preferred embodiment, as shown in FIG. 1, the number of turns of the lowermost-layer conductor pattern 31 is about 1.5 turns, the number of turns of the other plural conductor patterns 32, 33, and 34 are equally about 1 turn and, thereby, an increase in the inductance value and a reduction of an increase in the direct-current resistance value of the entire coil 30 are enhanced. Consequently, the Q characteristic of the entire coil can be further improved.

This is because if the number of turns of the lowermost-layer conductor pattern is an excessively large value, the inner diameter of the coil pattern becomes too small, and the Q characteristic is reduced. Conversely, if the number of turns is a small value almost indistinguishable from those of the other conductor patterns 32, 33, and 34, it becomes difficult to increase the inductance of the entire coil 30. From this point of view, the Q characteristic is optimized by setting the number of turns of the lowermost-layer conductor pattern 31 at about 1.5 turns and, in addition, setting the number of turns of the other conductor patterns 32, 33, and 34 at about 1 turn.

Finally, the operation and the effect of the fact that the conductor pattern 31 having the largest number of turns is disposed as the lowermost layer and is located substantially in the midsection in the thickness direction of the chip inductor 1 will be described.

Figure 8:
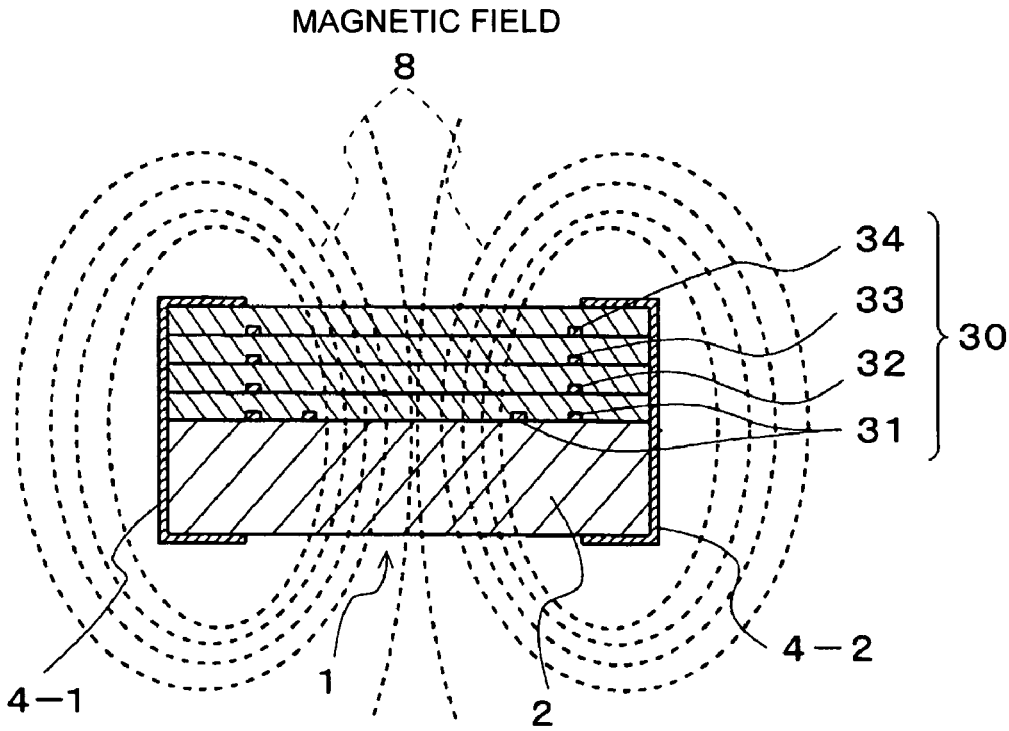
FIG. 8 is a sectional view schematically showing a distribution of magnetic fields in the case where a conductor pattern having the largest number of turns is disposed as the lowermost layer and is located substantially in the midsection of a chip inductor.
Figure 9:
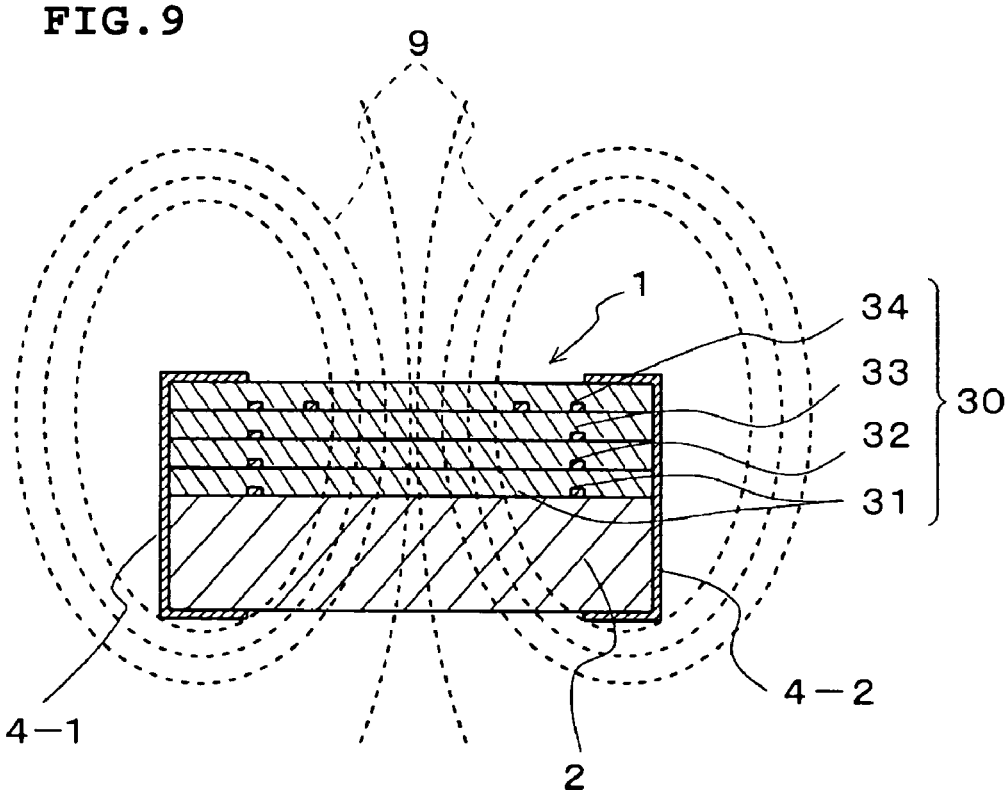
FIG. 9 is a sectional view schematically showing a distribution of magnetic fields in the case where a conductor pattern having the largest number of turns is disposed in the upper portion of a chip inductor.

FIG. 8 is a sectional view schematically showing a distribution of magnetic fields in the case where the conductor pattern having the largest number of turns is disposed as the lowermost layer and is located substantially in the midsection in the thickness direction of the chip inductor. FIG. 9 is a sectional view schematically showing a distribution of magnetic fields in the case where the conductor pattern having the largest number of turns is disposed in the upper portion of the chip inductor. In FIG. 8, the number of turns of the conductor pattern 31 is 2 turns and the number of turns of the other conductor patterns are 1 turn to facilitate explanation and understanding.

In the present preferred embodiment, as shown in FIG. 8, the conductor pattern 31 having the largest number of turns and the narrowest inner diameter is disposed as the lowermost layer and is located substantially in the midsection in the thickness direction of the chip inductor 1, while the conductor patterns 32, 33, and 34 having a small number of turns and wide inner diameters are disposed above the conductor pattern 31.

In such a state, magnetic fields 8 generated by the coil 30 and surrounding the coil 30 are not interrupted by the external connection electrodes 4-1 and 4-2 disposed on the left end and right end of the chip inductor 1 and, therefore, are expected to distribute with high magnetic flux densities. In this manner, the Q characteristic of the entire chip inductor 1 is improved.

On the other hand, as shown in FIG. 9, in the case where the conductor pattern 34 having the largest number of turns is disposed at the uppermost position and the conductor patterns 31, 32, and 33 having 1 turn are disposed under the conductor pattern 34, the entire distribution of magnetic fields 9 generated by the coil 30 is shifted toward the position of the conductor pattern 34 side, that is, upward. Therefore, a portion of the magnetic flux is interrupted by the external connection electrodes 4-1 and 4-2 of the chip inductor 1. As a result, the magnetic flux becomes hard to pass correspondingly, and the Q characteristic is not improved.

As described above, the Q characteristic of the chip inductor 1 can be improved by disposing the conductor pattern 31 having the largest number of turns directly on the ceramic substrate 2 having a thickness about one-half the thickness of the entire chip inductor 1 and located substantially in the midsection in the thickness direction of the entire chip inductor 1.

The present invention is not limited to the above-described preferred embodiments, and various modifications and changes can be made within the spirit and scope of the invention.

In one of the above-described preferred embodiments, the external dimension of each chip inductor 1 is preferably about 0.6 mm by about 0.3 mm. However, it is also possible that, for example, other dimensions, e.g., about 1.0 mm by about 0.5 mm, is provided, or the thickness of the ceramic substrate 2 is about 0.2 mm or about 0.25 mm.

In the above description, the ceramic substrate produced by firing alumina is preferably used as the substrate. However, it is also possible to use a wafer in place of the substrate, for example.

The lowermost layer conductor pattern 31 preferably has about 1.5 turns, and the other conductor patterns 32, 33, and 34 preferably have about 1 turn. However, the number of turns is not limited to this.

In the above-described preferred embodiments, the lowermost-layer conductor pattern 31 preferably has the largest number of turns. However, the preferred embodiments are not limited to this. That is, any one of the conductor patterns 31 and 32 located in the lower half portion of the plural conductor patterns 31 to 34 may have the largest number of turns.

While preferred embodiments of the present invention have been described above, it is to be understood that variations and modifications will be apparent to those skilled in the art without departing the scope and spirit of the invention. The scope of the invention, therefore, is to be determined solely by the following claims.

The invention claimed is:

1. A chip inductor comprising:

a chip main body and a pair of external connection electrodes, the chip main body including a substrate and a laminate including plural conductor patterns and plural insulating layers alternately laminated on the substrate, each conductor pattern including turns, the plural conductor patterns are connected to each other in series in a lamination direction thereof so as to constitute a coil, one of the external connection electrodes attached to one side-end surface of the chip main body and connected to one end of the coil, and the other external connection electrode attached to the other side-end surface of the chip main body and connected to the other end of the coil; wherein outer diameter dimensions of the plural conductor patterns constituting the coil are substantially equal; and a thickness of the laminate body and a thickness of the substrate are substantially equal, so that a lowermost-layer conductor pattern is located substantially in a midsection of the chip main body;

the lowermost-layer conductor pattern is the conductor pattern having the largest number of turns, and a number of turns of the other plural conductor patterns are substantially equal to each other; and the number of turns of the lowermost-layer conductor pattern is about 1.5 turns, and the number of turns of the other conductor patterns is about 1 turn.

2. The chip inductor according to claim 1, wherein each of the external connection electrodes has a shape substantially similar to a square bracket and extending from a top surface of the chip main body to a bottom surface along each side-end surface of the chip main body.

3. The chip inductor according to claim 1, wherein the conductor pattern in the lower half of the plural conductor patterns having the largest number of turns is arranged so as to prevent magnetic fluxes generated by the coil from passing through portions of the external connection electrodes located on a top surface and a bottom surface of the chip main body.

4. The chip inductor according to claim 1, further comprising openings disposed in the plural insulating layers, wherein the plural conductor patterns are connected in series in the lamination direction through the openings disposed in the plural insulating layers so as to constitute the coil.

5. The chip inductor according to claim 1, wherein the substrate comprises a ceramic substrate or a wafer, the conductor patterns are made of a photosensitive conductor paste, and the insulating layers are made of an insulating material paste.

6. The chip inductor according to claim 1, wherein line widths of the plural conductor patterns are substantially equal to each other.

7. A method for manufacturing a chin inductor comprising the steps of:

alternately repeating a step of forming a conductor pattern and a subsequent step of forming an insulating layer a plurality of times on a ceramic substrate or a wafer so as to form a chip main body, each conductor pattern including turns;

connecting the plural conductor patterns to each other in series in a lamination direction thereof so as to produce a chip inductor including a coil;

forming a number of turns of a lowermost-layer conductor pattern to be larger than a number of turns of the other plural conductor patterns; and forming the number of turns of the other plural conductor patterns to be substantially equal to each other; wherein the number of turns of the lowermost-layer conductor pattern is about 1.5 turns, and the number of turns of the other plural conductor patterns is about 1 turn.

8. The method for manufacturing a chip inductor according to claim 7, further comprising providing a pair of external connection electrodes, one of the external connection electrodes attached to one side-end surface of the chip main body and connected to one end of the coil, and the other external connection electrode attached to the other side-end surface of the chip main body and connected to the other end of the coil.

9. The method for manufacturing a chip inductor according to claim 8, wherein the conductor pattern in the lower half of the plural conductor patterns having the largest number of turns is arranged so as to prevent magnetic fluxes generated by the coil from passing through portions of the external connection electrodes located on a top surface and a bottom surface of the chip main body.

10. The method for manufacturing a chip inductor according to claim 7, further comprising the step of disposing openings in the insulating layers, and connecting the plural conductor patterns to each other in series in the lamination direction thereof through the openings so as to constitute the coil.

11. The method for manufacturing a chip inductor according to claim 7, wherein the steps of forming the conductor patterns and the insulating layers include forming the conductor patterns by patterning and firing a photosensitive conductor paste and firing an insulating material paste, respectively.

12. The method for manufacturing a chip inductor according to claim 7, wherein line widths of the plural conductor patterns are substantially equal to each other.

* * * * *